US009066373B2

(12) United States Patent
Kulp, Jr. et al.

(10) Patent No.: US 9,066,373 B2
(45) Date of Patent: Jun. 23, 2015

(54) CONTROL METHOD FOR AN INDUCTION COOKING APPLIANCE

(75) Inventors: John Michael Kulp, Jr., Louisville, KY (US); Gregory Francis Gawron, Sr., Jeffersontown, KY (US); Daniel Vincent Brosnan, Louisville, KY (US); Mingwei Shan, Louisville, KY (US)

(73) Assignee: General Electric Company, Schenectady, NY (US)

( * ) Notice: Subject to any disclaimer, the term of this patent is extended or adjusted under 35 U.S.C. 154(b) by 136 days.

(21) Appl. No.: 13/368,480

(22) Filed: Feb. 8, 2012

(65) Prior Publication Data

US 2013/0200069 A1 Aug. 8, 2013

(51) Int. Cl.
*H05B 6/06* (2006.01)

(52) U.S. Cl.
CPC ..... *H05B 6/062* (2013.01); *H05B 2213/05* (2013.01)

(58) Field of Classification Search
USPC ..... 219/620, 624, 660, 627, 625, 661, 626, 219/665, 668, 519, 672
See application file for complete search history.

(56) References Cited

U.S. PATENT DOCUMENTS 3,729,610 A * 4/1973 Kondo ..... 219/69.13
3,770,928 A * 11/1973 Kornrumf et al. ..... 219/626
3,775,577 A * 11/1973 Peters, Jr. ..... 219/626
3,781,505 A * 12/1973 Steigerwald ..... 219/626
3,781,506 A * 12/1973 Ketchum et al. ..... 219/627
3,823,297 A * 7/1974 Cunningham ..... 219/665
3,876,924 A * 4/1975 Peters, Jr. ..... 363/124
3,887,781 A * 6/1975 Peters, Jr. ..... 219/627
3,898,410 A * 8/1975 Peters, Jr. ..... 219/626
3,932,801 A * 1/1976 Peters, Jr. ..... 363/124
4,013,859 A * 3/1977 Peters, Jr. ..... 219/626
4,016,390 A * 4/1977 Amagami et al. ..... 219/665
4,016,392 A * 4/1977 Kobayashi et al. ..... 219/626
4,085,300 A * 4/1978 MacKenzie et al. ..... 219/625
4,145,592 A * 3/1979 Mizukawa et al. ..... 219/625
4,151,387 A * 4/1979 Peters, Jr. ..... 219/626
4,206,336 A * 6/1980 Cunningham ..... 219/622
4,209,683 A * 6/1980 Kiuchi et al. ..... 219/663
4,211,912 A * 7/1980 Kiuchi et al. ..... 219/665
4,467,165 A * 8/1984 Kiuchi et al. ..... 219/664
4,536,631 A * 8/1985 Tazima et al. ..... 219/625
4,540,866 A * 9/1985 Okuda ..... 219/664
4,736,082 A * 4/1988 Matsuo et al. ..... 219/626
4,798,925 A * 1/1989 Ishizaka ..... 219/665
4,820,891 A * 4/1989 Tanaka et al. ..... 219/626
5,165,049 A * 11/1992 Rotman ..... 323/212
5,424,514 A * 6/1995 Lee ..... 219/626
5,490,450 A * 2/1996 Lee ..... 99/337
5,548,101 A * 8/1996 Lee ..... 219/601
5,648,008 A * 7/1997 Barritt et al. ..... 219/626
6,140,617 A * 10/2000 Berkcan et al. ..... 219/446.1
6,462,316 B1 * 10/2002 Berkcan et al. ..... 219/502
6,630,650 B2 * 10/2003 Bassill et al. ..... 219/626
6,943,330 B2 * 9/2005 Ring ..... 219/661
7,075,044 B2 7/2006 Ryu et al.
7,473,872 B2 * 1/2009 Takimoto ..... 219/627

(Continued)

*Primary Examiner* — Dana Ross
*Assistant Examiner* — Lawrence Samuels
(74) *Attorney, Agent, or Firm* — Dority & Manning, P.A.

(57) ABSTRACT

A system and method of controlling an induction cooking appliance based on a feedback signal. A feedback signal sampling time interval may be triggered when a power control signal has a magnitude of zero. The feedback signal sample may be used to calculate a status factor and the appliance may be controlled based on the calculated status factor.

8 Claims, 8 Drawing Sheets

(56) References Cited

U.S. PATENT DOCUMENTS

| | | | | |
|---|---|---|---|---|
| 7,692,121 | B2 * | 4/2010 | Pinilla et al. | 219/494 |
| 8,004,206 | B2 * | 8/2011 | Sanchez | 315/291 |
| 8,853,991 | B2 * | 10/2014 | Shan et al. | 318/809 |
| 2003/0192881 | A1 * | 10/2003 | Bassill et al. | 219/626 |
| 2005/0121438 | A1 * | 6/2005 | Hirota et al. | 219/663 |
| 2008/0315792 | A1 * | 12/2008 | Sanchez | 315/297 |
| 2009/0167085 | A1 * | 7/2009 | Fonseca et al. | 307/32 |
| 2009/0173731 | A1 * | 7/2009 | Nagamitsu et al. | 219/622 |
| 2009/0321425 | A1 * | 12/2009 | Meier | 219/621 |
| 2010/0006563 | A1 | 1/2010 | Schilling et al. | |
| 2010/0147832 | A1 * | 6/2010 | Barker et al. | 219/626 |
| 2010/0181300 | A1 * | 7/2010 | Gutierrez | 219/620 |
| 2010/0196038 | A1 * | 8/2010 | Yamaguchi et al. | 399/69 |
| 2010/0243642 | A1 * | 9/2010 | Gouardo et al. | 219/622 |
| 2011/0000903 | A1 * | 1/2011 | Noguchi et al. | 219/620 |
| 2011/0000904 | A1 * | 1/2011 | Sakakibara et al. | 219/624 |
| 2011/0120989 | A1 * | 5/2011 | Schilling et al. | 219/661 |
| 2011/0160648 | A1 * | 6/2011 | Hoey | 604/26 |
| 2012/0018426 | A1 * | 1/2012 | Brosnan et al. | 219/672 |
| 2012/0285948 | A1 * | 11/2012 | Shan et al. | 219/660 |
| 2012/0305546 | A1 * | 12/2012 | Filippa et al. | 219/660 |

* cited by examiner

CONTROL METHOD FOR AN INDUCTION COOKING APPLIANCE

FIELD OF THE INVENTION

The present disclosure relates to an induction cooking appliance and more particularly to a system and method for controlling the induction cooking appliance based on a feedback sample of a control signal.

BACKGROUND OF THE INVENTION

Induction cooking appliances are more efficient, have greater temperature control precision and provide more uniform cooking than other conventional cooking appliances. In conventional cooktop systems, an electric or gas heat source is used to heat cookware in contact with the heat source. This type of cooking is inefficient because only the portion of the cookware in contact with the heat source is directly heated. The rest of the cookware is heated through conduction that causes non-uniform cooking throughout the cookware. Heating through conduction takes an extended period of time to reach a desired temperature.

In contrast, induction cooking systems use electromagnetism which turns cookware of the appropriate material into a heat source. A power supply provides a signal having a frequency to the induction coil. When the coil is activated a magnetic field is produced which induces a current on the bottom surface of the cookware. The induced current on the bottom surface then induces even smaller currents (Eddy currents) within the cookware thereby providing heat throughout the cookware.

Due to the efficiency of induction cooking appliances, precise control of a selected cooking temperature is needed. There are multiple means of controlling an induction cooking appliance. Some of these include mechanical switching, phase detection, optical sensing and harmonic distortion sensing. In some systems, these detection methods typically include a current transformer. However, current transducers yield an inconsistent and inaccurate output over a frequency range due to transformer loss principles. Moreover, current transformer packages can be expensive and have large package sizes and thus larger footprints.

Therefore, a need exists for a system and method of controlling an induction cooking appliance that overcomes the above mentioned disadvantages. A system and method that could control an induction cooking appliance based on a sample of a control signal would be useful. In addition, it would be advantageous to provide an induction cooktop system with the capability of sampling a control signal at a time interval triggered by the frequency of a power signal.

BRIEF DESCRIPTION OF THE INVENTION

Aspects and advantages of the invention will be set forth in part in the following description, or may be obvious from the description, or may be learned through practice of the invention.

A method of controlling an induction cooking appliance, including supplying a high frequency signal to a coil of the induction cooking appliance, detecting a power signal frequency, initiating a timer for a time interval when the frequency of the power signal has a magnitude of zero, sampling a signal through a shunt resistor after the time interval, and calculating at least one of a plurality of status factors based on the shunt resistor signal sample.

An induction cooking appliance, including a power supply providing a power signal having a frequency, a coil coupled to said power supply, a shunt resistor coupled to said coil, and a controller configured to initiate a timer for a time interval when the frequency of the power signal has a magnitude of zero, sample a signal through the shunt resistor after the time interval, and calculate at least one of a plurality of status factors based on the shunt resistor signal sample.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
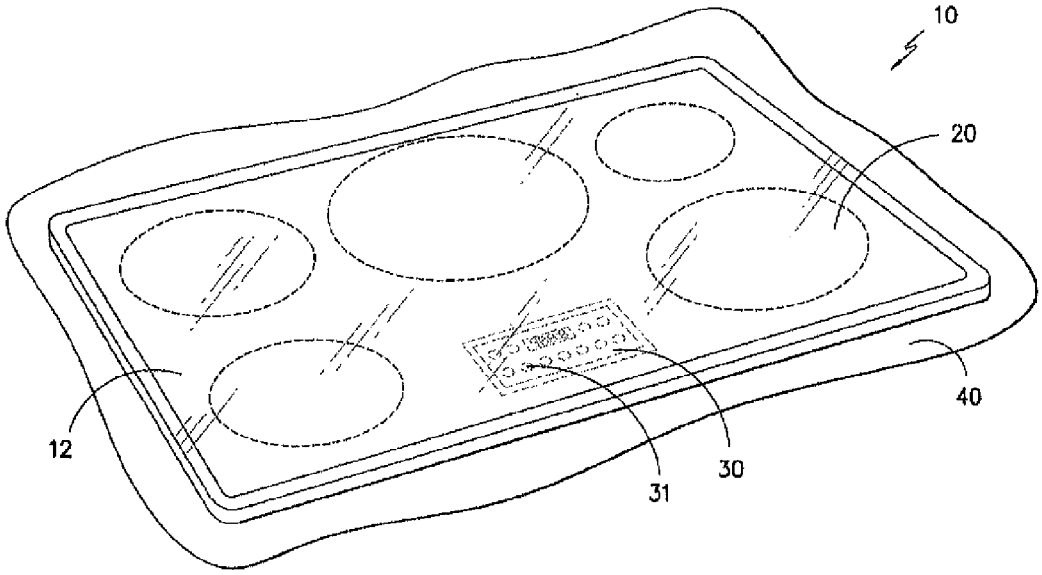
FIG. 1 provides a top, perspective view of an exemplary induction cooking system of the present disclosure.

The present invention relates to a system and method of controlling an induction cooking appliance based on a feedback signal. A feedback signal sampling time interval may be triggered when a power supply signal has a magnitude of zero. The feedback signal sample may be used to calculate a status factor and the appliance may be controlled based on the calculated status factor.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exemplary embodiment of an induction cooking appliance 10 of the present invention. Cooktop 10 may be installed in a chassis 40 and in various configurations such as in cabinetry in a kitchen, coupled with one or more ovens or as a stand-alone appliance. Chassis 40 may be grounded. Cooktop 10 includes a horizontal surface 12 that may be glass. Induction coil 20 may be provided below horizontal surface 12. It may be understood that cooktop 10 may include a single induction coil or a plurality of induction coils.

Cooktop 10 is provided by way of example only. The present invention may be used with other configurations. For example, a cooktop having one or more induction coils in combination with one or more electric or gas burner assemblies. In addition, the present invention may also be used with a cooktop having a different number and/or positions of burners.

A user interface 30 may have various configurations and controls may be mounted in other configurations and locations other than as shown in FIG. 1. In the illustrated embodiment, the user interface 30 may be located within a portion of the horizontal surface 30, as shown. Alternatively, the user interface may be positioned on a vertical surface near a front side of the cooktop 10 or anywhere a user may locate during operation of the cooktop. The user interface 30 may include a capacitive touch screen input device component 31. The input component 31 may allow for the selective activation, adjustment or control of any or all induction coils 20 as well as any timer features or other user adjustable inputs. One or more of a variety of electrical, mechanical or electro-mechanical input devices including rotary dials, push buttons, and touch pads may also be used singularly or in combination with the capacitive touch screen input device component 31. The user interface 30 may include a display component, such as a digital or analog display device designed to provide operational feedback to a user.

Figure 2:
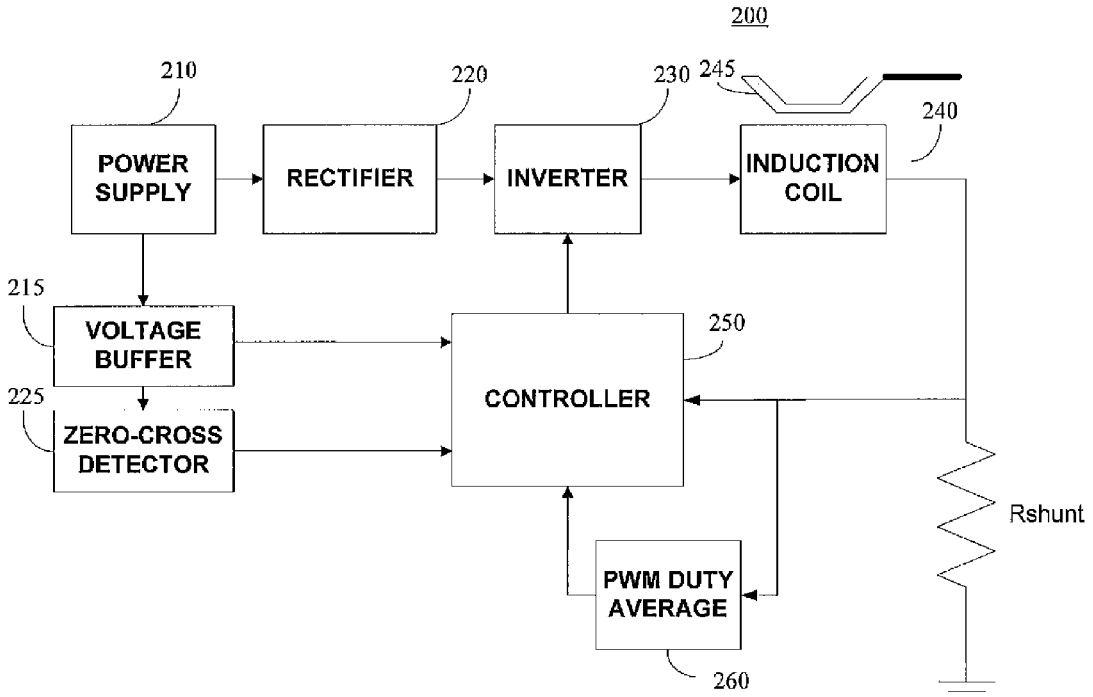
FIG. 2 provides a diagram of an exemplary induction cooking system of the present invention.

With reference now to FIG. 2, there is illustrated a schematic block diagram of a portion of an induction cooking appliance system 200. System 200 may include a power supply 210 configured to supply power to the induction coil 240 via rectifier 220 and inverter 230.

Power supply 210 provides rectifier 220 and voltage buffer 215 with a power signal, typically 120V. The rectifier 220 may convert the power signal into a high frequency signal to power the coil 240, where the signal may be in the range of 10 kHz to 50 kHz. The voltage buffer 215 may filter the input power signal to the zero-cross detector 225, where the input power signal may be used to determine a sampling frequency of a shunt resistor signal, as discussed below.

The controller 250 may include a memory and microprocessor, CPU or the like, such as a general or special purpose microprocessor operable to execute programming instructions or micro-control code associated with an induction cooking system. The memory may represent random access memory such as DRAM, or read only memory such as ROM or FLASH. In one embodiment, the processor may execute programming instructions stored in memory. The memory may be a separate component from the processor or may be included onboard within the processor.

Inverter 230 may be a half bridge resonant inverter or any other type of inverter that includes a plurality of insulated-gate bipolar transistors (IGBTs) or any other switching devices. The inverter 230 may supply a high frequency signal to activate the coil 240 and induce current within a cooking utensil 245. Inverter 230 may also be coupled to the controller 250.

A shunt resistor $R_{SHUNT}$ may be coupled to the coil 240 and the signal that flows through the coil 240 may induce a signal, such as a voltage, across shunt resistor $R_{SHUNT}$. The controller 250 may detect the signal across $R_{SHUNT}$ and the detected signal may be used as a feedback signal to control the induction cooking appliance via the inverter 230. In addition, a pulse width modulation duty average detector 260 may be coupled between the shunt resistor $R_{SHUNT}$ and the controller 250.

Figure 3:
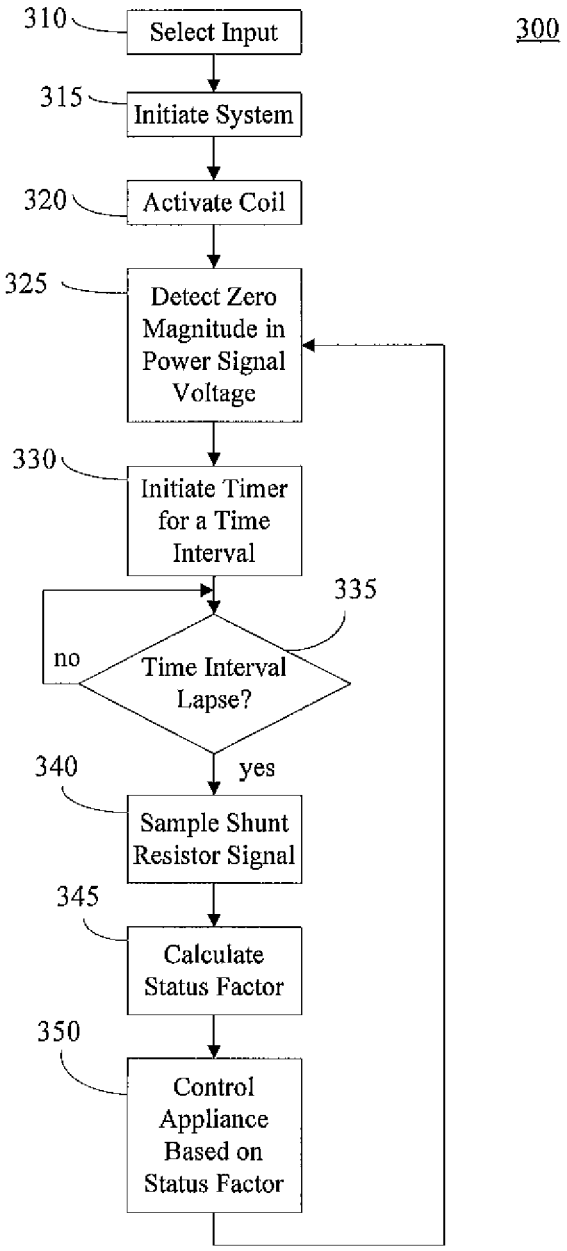
FIG. 3 provides a flow chart of a method of controlling an induction cooking appliance according to an exemplary embodiment of the present disclosure.

With reference now to FIG. 3, flowchart 300 may describe how the induction cooking appliance is controlled based on a feedback signal. Method 300 may be performed by controller 250 or by separate devices. At step 310, a user may select an input that initiates the system. For example, a user may select to activate a burner to heat to a selected temperature. In response, the system initiates at step 315 and power supply 210 may begin to supply power to the rectifier 220 and controller 240. The rectifier 220 may convert the power supply into a high frequency signal to activate the coil 240 in step 320. At step 325, the controller 250 monitors the power signal from the power supply 210 via voltage buffer 215 and detects when a magnitude of the signal reaches zero.

Figure 4:
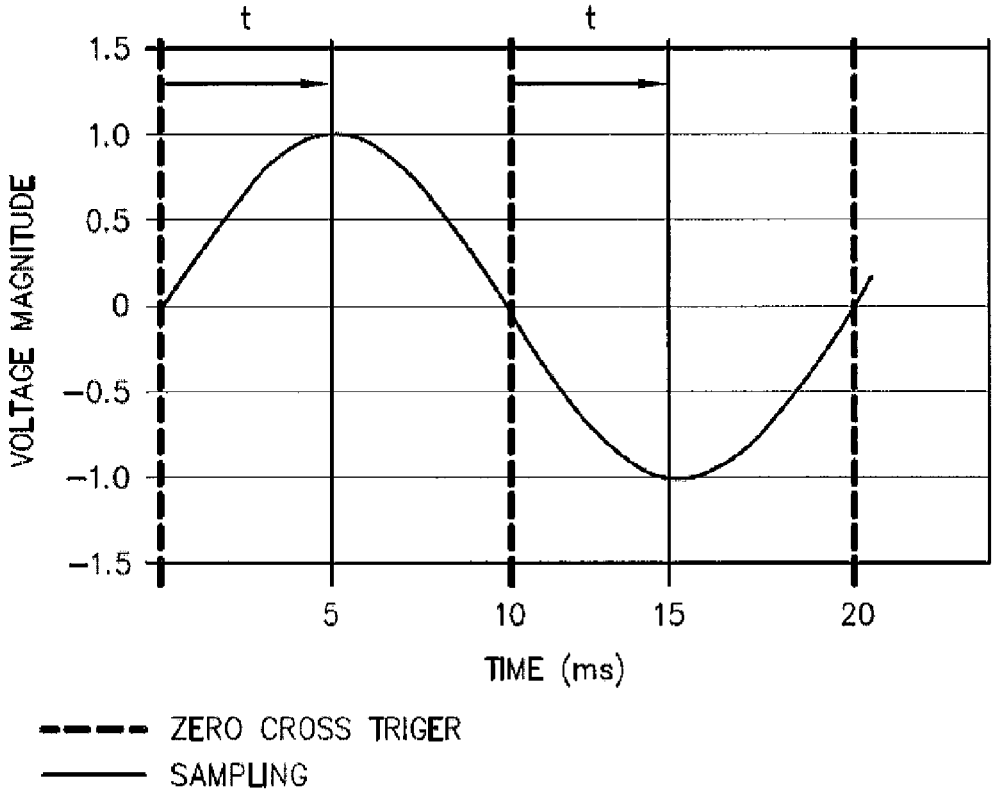
FIG. 4 provides a graph of a feedback signal according to an exemplary embodiment of the present disclosure.

As further illustrated by the graph of the power signal supplied to controller 250 in FIG. 4, a timer is initiated for a time interval t at step 330 when the magnitude of a signal equals zero ("zero cross trigger"). Time interval t may be monitored to determine whether the time interval t has elapsed in step 335. If the time interval t has not lapsed then the timer continues to be monitored.

After time interval t has lapsed, a signal across shunt resistor $R_{SHUNT}$ may be sampled in step 340 based on the power/input signal, for example at the peak of the power/input signal magnitude supplied to the controller 250 via the voltage buffer 215 the signal across shut resistor may be sampled. The sample may then be used to calculate a status factor in step 345. There are numerous status factors that may be calculated, such as coil attachment detection, cookware/pan presence detection, coil power level, material of cookware, cookware conductivity, placement of cookware with relation to the coil, resonance detection of the coil driving circuit, input current, coil current, gate switching loss, switching frequency and phase detection. The detected sample may be directly used to calculate a status factor or intermediate calculations using the detected sample may be used to calculate status factors.

In step 350, the induction cooking appliance may be controlled based on the calculated status factor. For example, if it is detected that a coil is no longer attached, the system may shut down and provide an indicator to the user. If coil power level has been changed or not yet reached, the controller may modify the signal frequency at which the gates are controlled. If the material of the cookware is not adequate for induction cooking, the controller may turn the system power off and provide an indicator to the user. If the conductivity of the cookware is modified (such as adding cold food to the pan), the controller may modify the signal frequency at which the gates are controlled. If the pan is moved off of the burner or is shifted to be only on a portion of the burner, the controller may modify the signal frequency at which the inverter is controlled or the controller may turn the system power off and provide an indicator to the user. If the driving circuit of the coil (e.g. inverter 230) operates below resonance, the controller may modify the signal frequency at which the inverter is controlled, the controller may turn the system power off and provide an indicator to the user or the controller may monitor a duration in which the system is operating below resonance and may control the system following a predetermined time interval. If the input current, coil current, inverter gate switching loss, switching frequency or phase detection is no longer within a predetermined range, the controller may modify the signal frequency at which the inverter gates are controlled, the controller may turn the system power off and provide an indicator to the user or the controller may monitor a duration in which the system is operating outside of the range and may control the system following a predetermined time interval.

Figure 5:
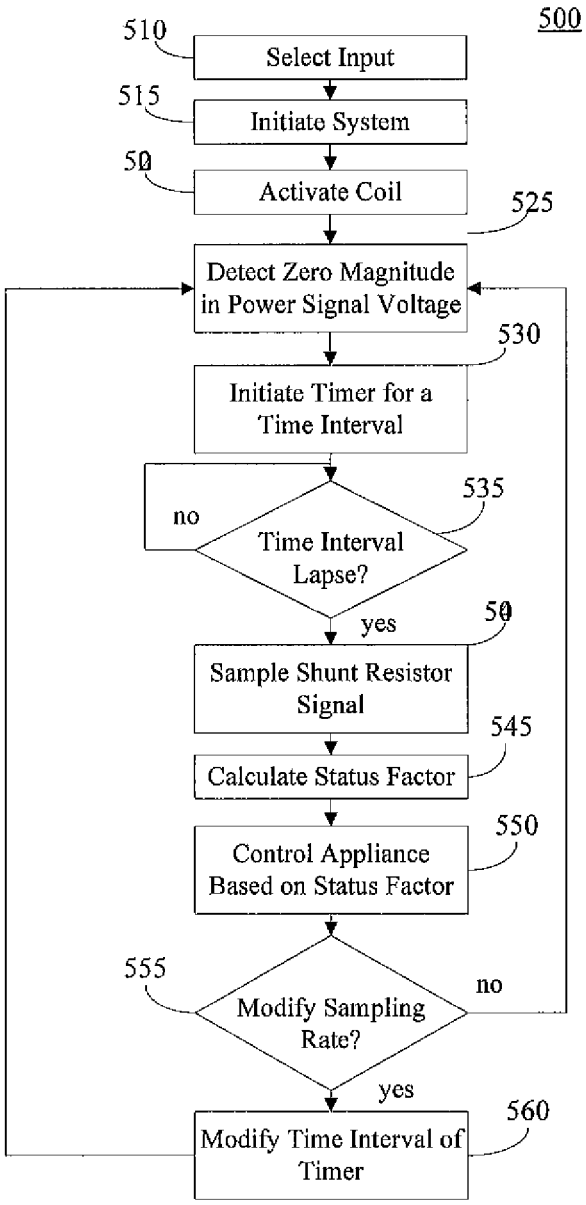
FIG. 5 provides a flow chart of a method of controlling an induction cooking appliance according to an exemplary embodiment of the present disclosure.

FIG. 5 shows an alternative embodiment of the present disclosure, where method 500 may include modifying the sampling rate of the shunt resistor signal. At step 510, a user may select an input that initiates the system. In response, the system initiates at step 515 and power supply 210 may begin to supply power to the rectifier 220 and the zero-cross detector 225 via voltage buffer 215. The rectifier 220 may convert the power supply into a high frequency signal to activate the coil 240 in step 520. At step 525, the controller 250 may monitor the power signal via the zero-cross detector 225 and detect when a magnitude of the signal reaches zero. A timer may be initiated for a time interval t at step 530 when the magnitude of a signal equals zero and time interval t may be monitored to determine whether the time interval t has elapsed in step 535. If the time interval t has not lapsed then the timer continues to be monitored. After time interval t has lapsed, a signal across shunt resistor $R_{SHUNT}$ is sampled in step 540. The sample may then be used to calculate a status factor in step 545 and the appliance may be controlled based on the calculated status factor in step 550.

Before the next zero magnitude, a decision may be made whether to modify the sampling rate of the shunt resistor signal in step 555. If there are no changes to the sampling rate, then method 500 returns to step 525 to detect the zero magnitude crossing of the power signal. If there is a change to the sampling rate, then the time interval of the timer is modified in step 560 before returning to step 525.

Figure 6:
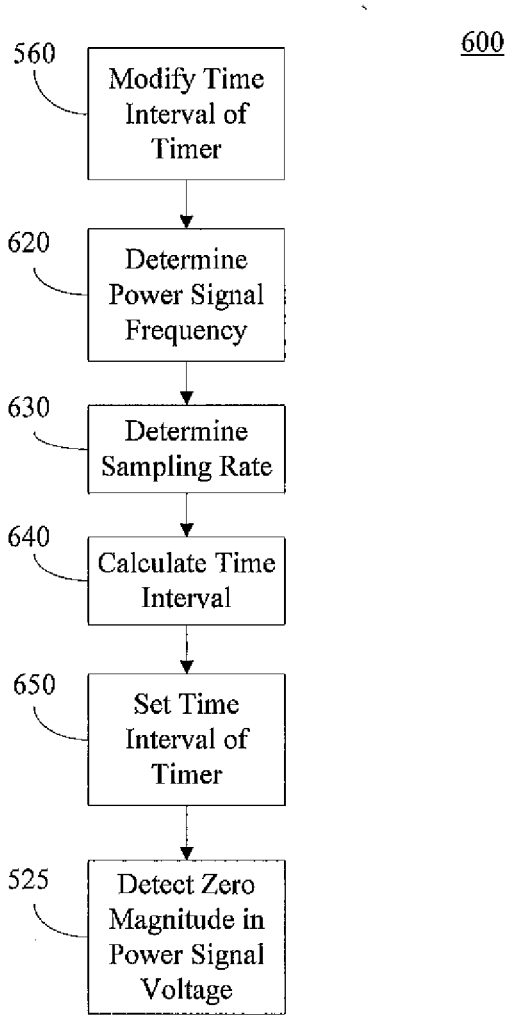
FIG. 6 provides a flow chart of a method of controlling an induction cooking appliance according to an exemplary embodiment of the present disclosure.

FIG. 6 further illustrates the steps included in modifying the time interval of the timer in method 600. After it is determined that a modification in time interval is desired in step 560, the frequency of the power signal is determined in step 620 and a sampling rate is determined in 630. In other words, it may be determined how many signal peaks are within a predetermined time interval and how many times during the predetermined time interval a sample should be taken.

After the frequency and sampling rate are determined, a time interval may be calculated in step 640 based on the frequency and sampling rate. The time interval of the timer may be set in step 650 before returning to step 525.

It is further contemplated that the sampling rate may vary during the selected input. For example, the sampling rate may be for every peak of the power signal for the entire cycle or the sampling rate may be every nth peak of the power signal for the entire cycle. Additionally, the sampling rate may be a first rate at the beginning of the cycle and change to a second rate at second point in the cycle, such as when resonance is achieved. Alternatively, the sampling rate may change dynamically throughout the entire cycle.

Figure 7:
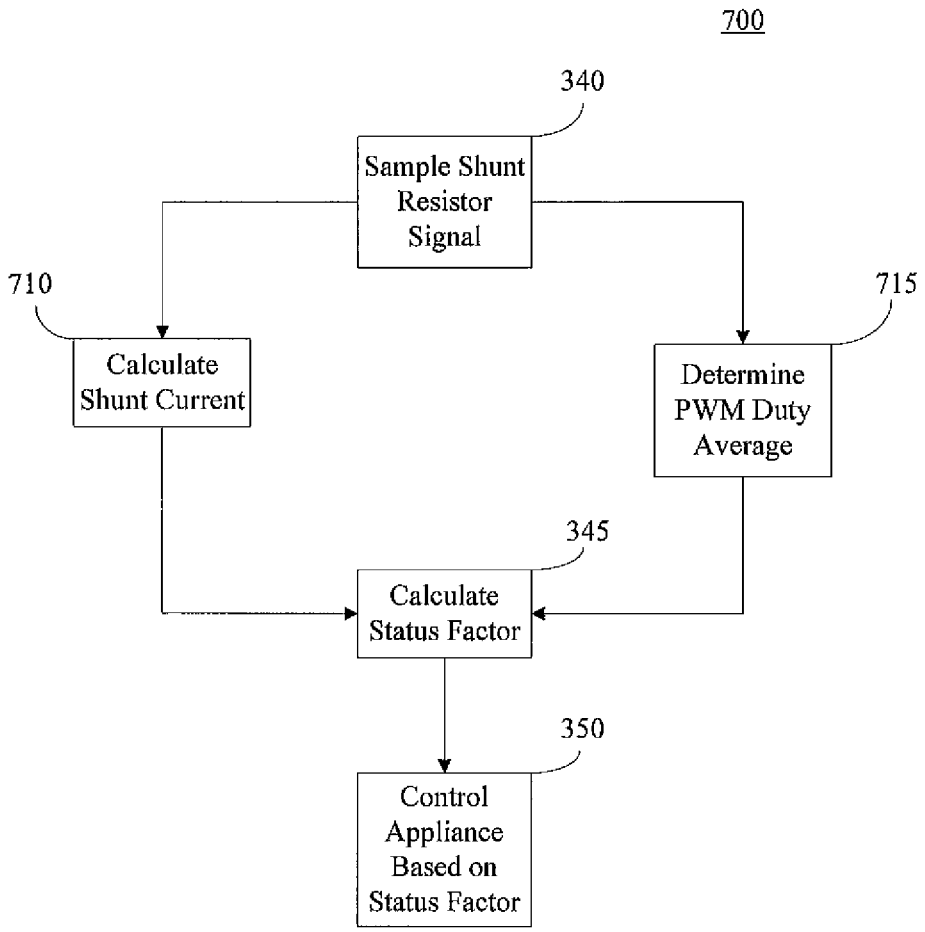
FIG. 7 provides a flow chart of a method of controlling an induction cooking appliance according to an exemplary embodiment of the present disclosure.

As shown in FIG. 7, an alternative embodiment of the present disclosure method 700 may calculate a status factor based on additional values. Beginning at step 340 a shunt resistor signal may be sampled. A voltage value may be directly sampled over the shunt resistor. The voltage value may be used to calculate the shunt resistor current in step 710 and to determine the pulse width modulation (PWM) duty average in step 715. Alternatively, the PWM duty average may be determined separate from a detected sample shunt resistor signal before calculating a status factor. These two values may then be used in the calculation of a status factor in step 345. The appliance may then be controlled based on the calculated status factor in step 350.

For example, the pan sense may be calculated based on the PWM duty average, the input current and coil current may be calculated based on the PWM duty average and the shunt current. The switching power loss may be calculated based on the PWM duty average, the shunt current and the shunt voltage and the switching frequency may be calculated based on the switching power loss. An exemplary system and method for calculating status factors such as pan sense, etc may be set forth in co-pending U.S. application Ser. No. 13/104,195 entitled "System and Method for Detecting Vessel Presence and Circuit Resonance for an Induction Heating Apparatus."

Figure 8:
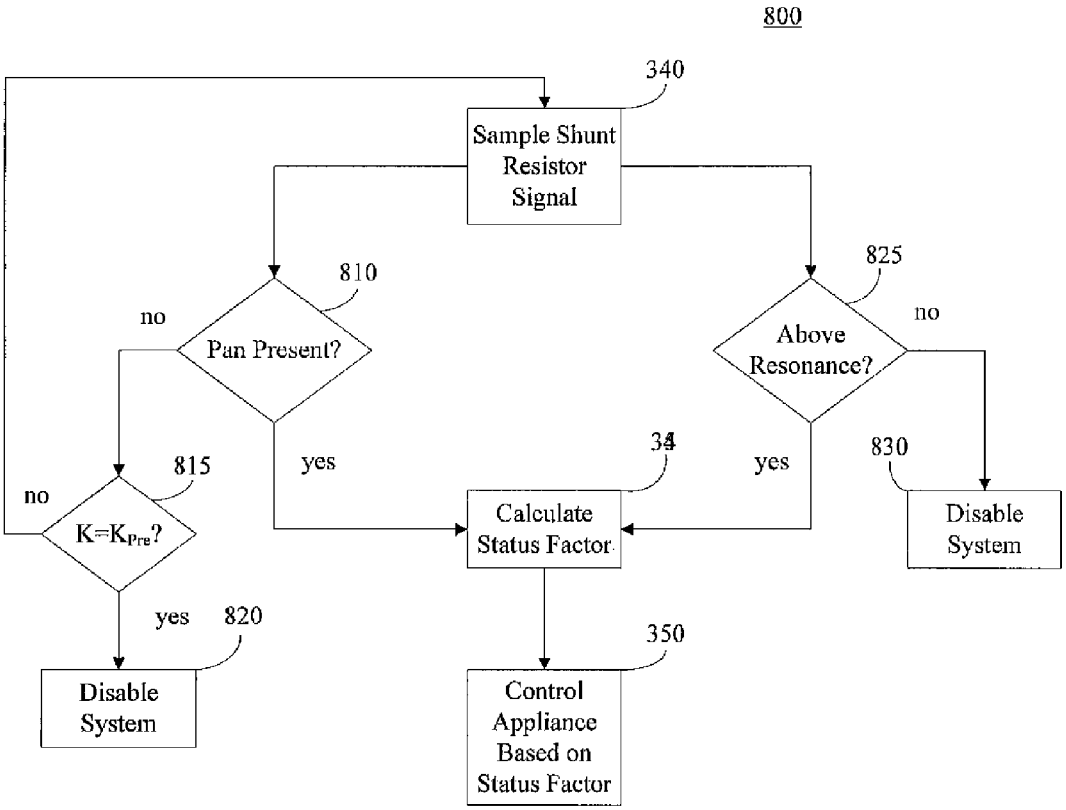
FIG. 8 provides a flow chart of a method of controlling an induction cooking appliance according to an exemplary embodiment of the present disclosure.

FIG. 8 further illustrates an alternative embodiment of the present disclosure. Method 800 contemplates determining a plurality of status factors. However, this illustration is merely an exemplary embodiment and by no means limits a situation when only a single status factor may be calculated.

After a shunt resistor signal such as a voltage is sampled in step 340, a pan presence may be determined in step 810. If a voltage is below a predetermined voltage limit, it may be determined that there is no pan present. When this is the case, a counter K may be initiated and compared to a predetermined number $K_{Pre}$ in step 815. If the counter K does not equal the predetermined number, the method continues to detect a zero magnitude and sample a shut resistor signal until the counter K does equal the predetermined number $K_{Pre}$. When counter K equals the predetermined number $K_{Pre}$ then the system is disabled in step 820 and an indication may be issued to the user. For example, if a pan is not detected then the cycle may loop 5 times before disabling the system.

A resonance determination of the driving circuit of the coil may also be performed. More specifically, in step 825 the sampled shunt resistor signal such as a voltage signal may be compared to a predetermined voltage to determine if the driving circuit is above resonance or below resonance. If the driving circuit is operating below resonance, the controller 250 may disable the system in step 830. The system may be disabled immediately after detection of below resonance or it may occur after a predetermined time period or a predetermined number of zero magnitude detections.

When a pan presence is detected and/or operation above resonance is detected, then the method continues to use the sampled shunt resistor signal to calculate a status factor in step 345 and to control the appliance based on the calculated status factor in step 350.

For all of the above methods, when a status factor is calculated one of ordinary skill would recognize that a single status factor could be calculated or a plurality of status factors may be calculated simultaneously or consecutively.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An induction cooking appliance, comprising:

a power supply providing a power signal having a frequency;

an inverter coupled to the power supply;

a coil coupled to said inverter, wherein said inverter provides a high frequency signal to said coil;

a shunt resistor coupled in series with said coil, wherein said shunt resistor provides a voltage signal indicative of the voltage across the shunt resistor;

a voltage buffer coupled to the power supply, the voltage buffer configured to filter the power signal;

a zero-cross detector configured to detect when a magnitude of the power signal reaches zero;

a controller, the controller comprising:

one or more processors; and one or more non-transitory computer-readable media storing instructions that, when executed by the one or more processors, cause the one or more processors to perform operations, the operations comprising:

determining the frequency of the power signal;

determining a sampling rate, wherein the sampling rate indicates a number of peaks of the power signal that should occur for each instance of sampling;

calculating a duration of a sampling delay interval based on the frequency of the power signal and the sampling rate;

determining when the power signal has a magnitude of zero based on the zero-cross detector;

initiating a timer for the duration of the sampling delay interval when the power signal has a magnitude of zero;

obtaining a sample of voltage across the shunt resistor based on the voltage signal from the shunt resistor upon the expiration of the sampling delay interval; and calculating at least one of a plurality of status factors based on the sample of the voltage across the shunt resistor.

2. The induction cooking appliance as in claim 1, wherein the operations further comprise controlling the induction cooking appliance based on the at least one calculated status factor.

3. The induction cook appliance as in claim 2, wherein controlling the induction cooking appliance based on the at least one calculated status factor comprises controlling the induction cooking appliance by adjusting the high frequency signal.

4. The induction cooking appliance of claim 1, wherein the operations further comprise:

determining when a signal frequency of the high frequency signal is less than a resonant frequency associated with the coil; and increasing, by controlling the inverter, the signal frequency of the high frequency signal to exceed the resonant frequency when it is determined that the signal frequency is less than the resonant frequency.

5. The induction cooking appliance of claim 1, wherein the operations further comprise dynamically adjusting the sampling delay interval during an operational cycle.

6. An induction cooking appliance, comprising:

a power supply providing a power signal having a frequency;

a rectifier coupled to the power supply;

an inverter coupled to the rectifier;

a coil coupled to said inverter, wherein said inverter provides a high frequency signal to said coil;

a shunt resistor coupled in series with said coil, wherein said shunt resistor provides a voltage signal indicative of the voltage across the shunt resistor;

a voltage buffer coupled to the power supply, the voltage buffer configured to filter the power signal;

a zero-cross detector configured to detect when a magnitude of the power signal reaches zero;

a controller, the controller comprising:

one or more processors; and one or more non-transitory computer-readable media storing instructions that, when executed by the one or more processors, cause the one or more processors to perform operations, the operations comprising:

determining a sampling rate, wherein the sampling rate indicates a number of peaks of the power signal that should occur for each instance of sampling;

calculating a duration of a sampling delay interval based on the frequency of the power signal and the sampling rate;

determining when the power signal has a magnitude of zero based on the zero-cross detector;

initiating a time for the duration of the sampling delay interval when the power signal has a magnitude of zero;

obtaining a sample of a voltage across the shunt resistor based on the voltage signal from the shunt resistor upon the expiration of the sampling delay interval;

determining whether a pan is present based on the sample of the voltage;

incrementing a counter when it is determined that a pan is not present based on the sample of the voltage; and disabling the inverter when the counter equals a predetermined cutoff number.

7. The induction cooking appliance of claim 6, wherein the operations further comprise resetting the counter to zero when it is determined that a pan is present based on the sample of the voltage.

8. The induction cooking appliance of claim 1, wherein calculating at least one of a plurality of status factors based on the sample of the voltage across the shunt resistor comprises calculating a resonance operation detector based on the sample of the voltage across the shunt resistor.

* * * * *